US006750175B2

(12) United States Patent
Furukawa

(10) Patent No.: US 6,750,175 B2
(45) Date of Patent: Jun. 15, 2004

(54) UNIDIRECTIONALLY PENETRABLE ORNAMENTAL FILM

(76) Inventor: Ken-ichi Furukawa, 1-11-13, Yukarigaoka, Sakura-shi, Chiba (JP)

( * ) Notice: Subject to any disclaimer, the term of this patent is extended or adjusted under 35 U.S.C. 154(b) by 212 days.

(21) Appl. No.: 09/980,671

(22) PCT Filed: Mar. 8, 2001

(86) PCT No.: PCT/JP01/01815

§ 371 (c)(1),
(2), (4) Date: Oct. 31, 2001

(87) PCT Pub. No.: WO01/70518

PCT Pub. Date: Sep. 27, 2001

(65) Prior Publication Data

US 2002/0155952 A1 Oct. 24, 2002

(30) Foreign Application Priority Data

Mar. 21, 2000 (JP) ..... 2000-121747
May 17, 2000 (JP) ..... 2000-183708

(51) Int. Cl.[7] ..... B41M 5/035; B41M 5/38
(52) U.S. Cl. ..... 503/227; 428/137; 428/354
(58) Field of Search ..... 8/471; 428/195, 428/913, 914, 212, 352, 354, 137; 503/227

(56) References Cited

U.S. PATENT DOCUMENTS 5,462,911 A * 10/1995 Takao et al. ..... 503/227
5,789,341 A * 8/1998 Furukawa ..... 503/227

* cited by examiner

*Primary Examiner*—B. Hamilton Hess
(74) *Attorney, Agent, or Firm*—Dennis G. LaPointe; Mason Law, P.A.

(57) ABSTRACT

A unidirectionally penetrable ornamental film comprising a laminate having a transparent resin film 3 in which a sublimable dye is diffusible, a white coating layer 2 on the transparent resin film 3, a light-shielding color coating layer 1 on the white coating layer 2, a pressure sensitive adhesive layer 4 on a surface of the transparent resin film 3 opposite to a surface on which the white coating layer 2 is provided, and a separator 5 on the pressure sensitive adhesive layer 5, in which throughholes having an area of 10 $mm^2$ or less are formed in an opening ratio in the range of 30 to 70% and resins that constitute the white coating layer 2 and the light-shielding color coating layer 1 have no affinity for the sublimable dye. Also disclosed is a unidirectionally penetrable ornamental film, comprising a dye image on the ornamental film, the image being obtained by superimposing a transfer paper having recorded thereon an image with an ink containing a sublimable dye, contacting the transfer paper with the ornamental film and heating the transfer paper to pass the sublimable dye through the light-shielding color coating layer 1 and the white coating layer 2 to thereby transfer dye the transparent resin film in a high density.

8 Claims, 1 Drawing Sheet

(A)

(A)

(B)

UNIDIRECTIONALLY PENETRABLE ORNAMENTAL FILM

TECHNICAL FIELD

The present invention relates to a unidirectionally penetrable (or one-way see-through) ornamental film that is applied to a glass window, a transparent acrylic plate or the like.

BACKGROUND ART

Hitherto, a unidirectionally penetrable film called oneway vision has been known. This comprises a film painted in a light-shielding color such as black on one surface thereof and in white on another surface thereof, and a pressure sensitive adhesive layer and a separator provided on the light-shielding color surface. The film is perforated with a number of throughholes of a diameter of approximately 1 to 2 mm in an opening ratio of approximately 30 to 70%. When in use, the separator is peeled off and then applied to a glass window of a room. When viewing the outside from inside the room in a daytime through the film, one views a bright world through a number of throughholes arranged overall the light-shielding color surface, so that he or she can see the outside through it, with a feeling that the eyesight has not been blocked so much due to illusion of sight. On the contrary, when viewing the inside of the room from outside through the film, it is almost impossible for one to view the inside since he or she views the darker world through the throughholes. In this manner, oneway vision film has a function of a blind against seeing from one direction while sufficiently maintaining an eyesight from another direction.

Recently, various images have been laid on the white surface of such a unidirectionally penetrable film in order to improve advertising or amenity effects. At present, in order to lay an image on the white surface of the film for that purpose, an image recorded on an electrostatic recording paper using a color electrostatic plotter is transferred to the white surface of a film by heat-pressing. This is because the principle can be utilized that a 3 to 5 $\mu$m-thick dielectric layer (composed of a resin) onto which an image is fixed can be peeled off as a whole by giving moisture to it or by heating it.

The film used in the method described above has the structure in which an image is laid on its white surface and a pressure sensitive adhesive layer is laminated on the light-shielding color surface and in an in situ operation, the film is applied to the outer side of a glass window. The film applied to the outer side when viewed from the outside has the defect of losing the feeling of transparency inherent to the glass window that would otherwise be retained. Other defects of this film are as follows. It tends to be peeled off from the glass. The throughhole portion comprises protrusions and depressions so that it is readily befouled and difficult to clean. In this case, the thin resin film of the dielectric layer containing the transferred image is designed to cover the throughholes, which also damages the transparent feeling of throughholes. In addition, the image as it is not resistant to light under direct sunshine. To improve the light resistance of the image, there is no way other than laminating an ultraviolet ray shielding film, which not only further deteriorates the transparent feeling but also increases the production costs.

Therefore, a unidirectionally penetrable film having improved advertising and amenity effects that maintains transparent feeling of a glass window and that of throughhole portion, is hardly peeled off from the glass window, is hardly befouled and has light resistance is keenly desired.

The present inventors previously disclosed the technology on the "method for fabricating an imaged film" (Japanese Patent No. 2,934,948 (U.S. Pat. No. 5,789,341).

This is a technology using a laminate film comprising a transparent resin film in which a sublimable dye can be diffused and a white resin film that has no affinity for a sublimable dye, and a transfer paper on which an image has been recorded with an ink containing a sublimable dye is contacted and heated to diffuse the sublimable dye through the white resin film into the transparent resin film to develop a transferred image on the side of transparent film.

This technology shows that upon heating, a sublimable dye is imagewise transferred through a laminate film comprising a white resin film that has no affinity for the sublimable dye and a transparent resin film that allows diffusion of the sublimable dye therein by diffusing from the surface of the white resin film to the side of the transparent resin film on the opposite side of the laminate film independently of color.

SUMMARY OF THE INVENTION

The present inventors have made extensive studies with a view to solving the problems of the unidirectionally penetrable film described above and as a result they have found that use of an ornamental film comprising a laminate having a transparent resin film in which a sublimable dye is diffusible, a white coating layer on the transparent resin film, and a light-shielding color coating layer on the white coating layer, in which resins that constitute the white coating layer and the light-shielding color coating layer have no affinity for the sublimable dye can fundamentally dissolve the above-described problems. The present invention is based on this discovery.

More particularly, by superimposing a transfer paper having recorded thereon an image with an ink containing a sublimable dye onto the light-shielding color surface of the ornamental film and contacting the transfer paper therewith and heating the transfer paper, the sublimable dye on the transfer paper can be passed through the light-shielding color coating layer and white coating layer to thereby transfer the dye to the transparent resin film in a high density. On this occasion, if a pressure sensitive adhesive layer and a separator thereon are further provided on the side of the transparent resin film, a transferred image appears so that it can be viewed from the side of the pressure sensitive adhesive layer. In this state, the separator can be peeled off and the pressure sensitive adhesive layer of the ornamental film having the transferred image backed by the white coating layer can be applied as it is to the inner side of a glass window. Throughholes, if any, formed in the ornamental film in a predetermined opening ratio make it possible to use the ornamental film as a unidirectionally penetrable ornamental film through which the outside can be viewed clearly from the inside the glass window but the inside cannot be viewed from the outside.

That is, the present invention provides the following unidirectionally penetrable ornamental film before image transfer and unidirectionally penetrable ornamental film after image transfer.

1. A unidirectionally penetrable ornamental film comprising a laminate having a transparent resin film 3 in which a sublimable dye is diffusible, a white coating layer 2 on the transparent resin film 3, a light-shielding color coating layer 1 on the white coating layer 2, a pressure sensitive adhesive layer 4 on a surface of the transparent resin film 3 opposite to a surface on which the white coating layer 2 is provided, and a separator 5 on the pressure sensitive adhesive layer 4, wherein resins that constitute the white coating layer 2 and the light-shielding color coating layer 1 have no affinity for the sublimable dye.

2. A unidirectionally penetrable ornamental film according to 1 above, wherein the transparent resin film 3 comprises a laminate film having a transparent resin support film 3*a* and a transparent coating layer 3*b* in which the sublimable dye is diffusible, the transparent coating layer being laminated on the transparent resin support film 3*a*.
3. A unidirectionally penetrable ornamental film according to 1 above, wherein the resin having no affinity for the sublimable dye is selected from the group consisting of a fluoro resin, a silicone resin and an olefin resin.
4. A unidirectionally penetrable ornamental film according to 1 above, wherein the light-shielding color of the light shielding color coating layer 1 is a color selected from the group consisting of black, intense dark achromatic color and intense dark chromatic color.
5. A unidirectionally penetrable ornamental film according to 1 above, wherein the transparent resin film 3 contains an ultraviolet absorbent.
6. A unidirectionally penetrable ornamental film according to 2 above, wherein at least one of the transparent resin support film 3*a* and transparent coating layer 3*b* contains an ultraviolet absorbent.
7. A unidirectionally penetrable ornamental film according to any one of 1 to 6 above, wherein the ornamental film is formed with throughholes 6 having an area of 10 $mm^2$ or less in an opening ratio of 30 to 70% overall surfaces thereof.
8. A unidirectionally penetrable ornamental film according to 7 above comprising a dye image on the light-shielding color coating surface of the ornamental film, the image being obtained by superimposing a transfer paper having recorded thereon an image with an ink containing a sublimable dye, contacting the transfer paper with the ornamental film and heating the transfer paper to pass the sublimable dye through the light-shielding color coating layer and the white coating layer to thereby transfer the dye to the transparent resin film in a high density.
9. A unidirectionally penetrable ornamental film, comprising a transparent resin film 3 in which a sublimable dye is diffusible, a white coating layer 2 on the transparent resin film 3, and a light-shielding color coating layer 1 on the white coating layer 2, wherein the transparent resin film 3 is dyed with an image comprising the sublimable dye and is formed with throughholes 6 having an area of 10 $mm^2$ or less in an opening ratio of 30 to 70% overall surfaces thereof, the ornamental film being applied to a transparent element on the side of the transparent film.

MODE FOR CARRYING OUT THE INVENTION

Figure 1:
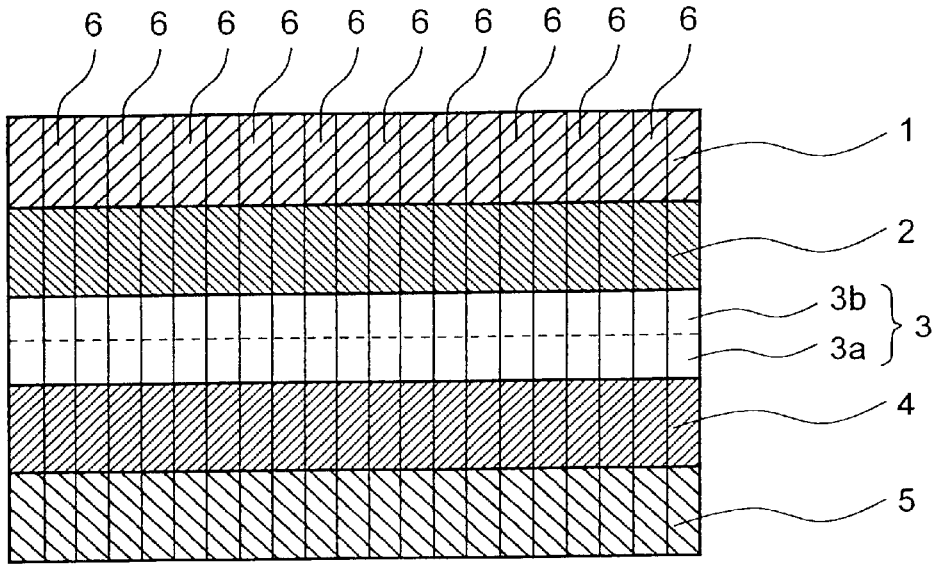
FIG. 1A is a cross-sectional view showing a unidirectionally penetrable ornamental film according to a basic embodiment of the present invention.
FIG. 1B is a plan view of the ornamental film shown in FIG. 1A.
Figure 1:
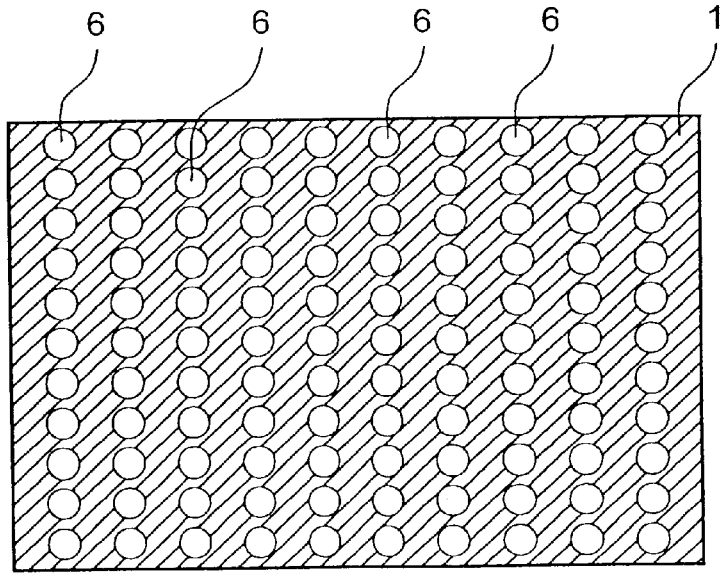

An example of basic construction of a unidirectionally penetrable ornamental film is illustrated in a cross-sectional view (FIG. 1A) and in a plan view (FIG. 1B).

In the figures, reference numeral 3 indicates a transparent resin film composed of a resin material in which a sublimable dye is diffusible. On one surface of the transparent resin film 3 is provided a white coating layer 2 and a light-shielding color coating layer 1 in order. As the resin for the white coating layer 2 and the light-shielding color coating layer 2, a resin that has no affinity for the sublimable dye.

On the opposite surface of the white coating layer of the transparent resin film 3 is formed a tacky layer (pressure sensitive adhesive layer) 4 and a separator 5 on the layer 4.

In the present invention, the resin constituting the white coating layer and the light-shielding color coating layer that has no affinity for the sublimable dye to be used is selected from the group consisting of a fluoro resin, a silicone resin and an olefin resin is used.

The fluoro resin includes homopolymers of fluoro olefins, copolymers of fluoro olefins, or copolymers of fluoro olefins and monomers other than the fluoro olefins, for example, polyvinyl fluoride, polyvinylidene fluoride, polytetrafluoroethylene, tetrafluoroethylene-perfluoroalkyl vinyl ether copolymer, tetrafluoroethylene-hexafluoro propylene copolymer, tetrafluoroethylene-ethylene copolymer, polychlorotrifluoroethylene and the like. The silicone resin includes, for example, pure silicone resin, silicone-modified resins (alkyd, epoxy, phenol, urethane, acrylic, melamine, etc. resins) and the like. The olefin resin includes, for example, polyethylene, polypropylene, polyvinyl chloride and the like. It is preferred that these resins contain an ultraviolet absorbent and/or an antioxidant. Examples of the ultraviolet absorbent include hydroxybenzoquinone compounds, benzotriazole compounds, salicylic acid ester compounds, oxalic acid anilide compounds, and the like. The antioxidant includes, for example, hindered compounds, hindered phenol compounds, phosphite compounds and the like.

The above-described resins can be used as solutions of organic solvents. The organic solvents may be suitably selected from those commonly used, such as esters (ethyl acetate, butyl acetate, etc.), aromatic hydrocarbons (toluene, etc.), aliphatic or alicyclic hydrocarbons (hexane, cyclohexane, etc.), alcohols (ethanol, isopropanol, etc.), ketones (acetone, methyl isobutyl ketone, etc.), and amides (dimethylformamide, dimethylacetamide, etc.) so that they are compatible with the resins.

The thicknesses of the white coating layer and of the light-shielding color coating layer may be of minimal ones that are sufficient for shielding the background image color of the adjacent layer. Generally, these layers are each laminated by coating a crosslink-curing type paint to a thickness of 1 to 40 $\mu$m, preferably 3 to 20 $\mu$m. The light-shielding color may be any optional color as far as it can shield the background. Generally, the light-shielding color may be a chromatic color having a low lightness, intense dark color, in particular black color is preferred from the viewpoint that no residue of the transferred image is seen on the light-shielding color coated surface and that the illusion effect when viewing outside can be enhanced.

In the present invention, the resin used as the transparent film 3 may be of any type as far as it has sufficient heat resistance to endure contact heating and as far as the sublimable dye is diffusible therein. The resins having affinity for the sublimable dye as described above are preferred. This is because such resins are excellent in the function of positively absorbing the sublimable dye that passes through the light-shielding color coating layer and the white coating layer, with the result that the transparent film can be dyed in a high density. Examples of such a transparent resin film include polyesters, polycarbonates, polyvinyl alcohols, polyurethanes, polyvinyl chloride containing a polymeric plasticizer, and the like.

The transparent resin film 3 may be constituted by a transparent laminate film that comprises a transparent resin support film 3*a* and a transparent coating layer 3*b* in which the sublimable dye is diffusible. In this case, the transparent resin support film 3*a* does not have to have the property of diffusing the sublimable dye therein and any material can be used as far as it is a support having a transparence. For example, a transparent polyester film may be used on which a crosslink-curing type resin is laminated that can carry the sublimable dye in a stable manner without causing bleeding. For example, polyester resins, silicone polyester resins, epoxy resins, polyurethane resins may be used. These resins may be coated on the transparent resin support film to a thickness of 3 to 40 $\mu$m, preferably 10 to 30 $\mu$m, to laminate the transparent coating layer 3*b*.

In this case, the sublimable dye to be transferred is protected by the transparent resin support film 3*a* itself and the transparent coating layer 3*b*, so that it is excellent in light resistance.

Further, to further improve the light resistance, an ultraviolet absorbent and/or antioxidant as described above known and used commonly in the art may be blended in one or both of the transparent resin support film and the transparent coating layer.

As the separator, craft paper, polyester film base heat resistant separators may be used. As the pressure sensitive adhesive layer, heat resistant pressure sensitive adhesives such as an acrylic adhesive may be used.

The method for producing a unidirectionally penetrable ornamental film of the present invention is not particularly limited.

For example, a white coating layer is laminated and cured to a predetermined thickness on a transparent resin film or a transparent laminate film composed of a transparent resin support film layer and a transparent coating layer and then a light-shielding color coating layer, a second layer, is laminated and cured thereon, followed by applying a pressure sensitive adhesive layer and a separator on the opposite surface of the film to produce the unidirectionally penetrable ornamental film of the present invention.

In the case where a film having low solvent resistance (polyurethane film, polyvinyl chloride based film, etc.) unlike polyester films is used as the transparent resin film, or where the transparent resin film itself is produced by coating, the film formation is performed by a casting process. That is, on a film-forming sheet first a light-shielding color coating layer as the uppermost layer, a white coating layer and then a transparent film layer are formed in order by solvent coating, a pressure sensitive adhesive is coated thereon, and then a separator is applied thereto.

Then, overall the ornamental film, throughholes 6 are perforated using a commercially available punch. The shape and proportion (opening ratio) of the throughholes 6 may be optionally varied depending on the purpose. In order for the ornamental film to have a function of a blind when viewed from the outside and allow viewing the outside without discordant or strange feeling, it is preferred that throughholes having an area 10 $mm^2$ or less be regularly perforated in an opening ratio in the range of approximately 30 to 70% overall the ornamental film.

The sublimable dye used for dyeing an image on the unidirectionally penetrable ornamental film of the present invention to produce a unidirectionally penetrable ornamental film with an image according to the present invention may be any dye as far as it has a sublimating or vaporizing function. Preferably, the sublimable dye used in the present invention is a dye that sublimates or vaporizes at 70 to 260° C. under atmospheric pressure. Such a dye includes, for example, azo, anthraquinone, quinophthalone, styryl, di- or triphenylmethane, oxazine, triazine, xanthene, methine, azomethine, cyclidine, diazine and the like sublimable or vaporizable dyes. In addition to these, there can be used 1,4-dimethylamino anthraquinone, 1,5-dihydroxy-4,8-diaminoanthraquinone bromide or chloride, 1,4-diamino-2,3-dichloroanthraquinone, 1-amino-4-hydroxyanthraquinone, 1-amino-4-hydroxy-2-(β-methoxyethoxy)anthraquinone, 1-amino-4-hydroxy-2-phenoxyanthraquinone, 1,4-diaminoanthraquinone-2--carboxylic acid methyl, ethyl, propyl or butyl ester, 1-amino-4--anilide-anthraquinone, 1-amino-2-cyano-4-anilide (or cyclohexylamino)-anthraquinone, 1-hydroxy-2-(p-acetaminophenylazo)-4-methylbenzene, 3-methyl-4-nitrophenylazo-pyrazolone, 3-hydroxyquinophthalone and the like dyes. Also, basic dyes, for example, malachite green, methyl violet and the like may be used. Dyes modified with sodium acetate, sodium ethanolate, sodium methylate or the like may also be used.

BEST MODE FOR CARRYING OUT THE INVENTION

Hereinafter, the present invention will be described in detail by examples. However, the present invention should not be construed as being limited thereto.

EXAMPLE 1

On a 50-$\mu$m thick biaxially stretched transparent polyester film (Teijin Tetron Film S6, trade name, produced by Teijin Limited) was first laminated a tetrafluoro resin paint (a fluoroethylene-vinyl ether copolymer based paint) (DUFLON 4F Fresh White, trade name, produced by Nippon Paint) to a thickness of 15 $\mu$m and cured to form a white coating layer as a first layer. Then a tetrafluoro resin paint (DUFLON 4F Fresh Black, trade name, produced by Nippon Paint) was laminated to a thickness 15 $\mu$m and cured to form a light-shielding color coating layer as a second layer. Thereafter, a pressure sensitive adhesive layer is laminated on the opposite surface of the film and a heat resistant separator was applied thereon. The film was regularly perforated with circular throughholes of 1.5 mm in diameter in an opening ratio of 50% overall the surface thereof to prepare a unidirectionally penetrable ornamental film. On the black paint coated surface of the ornamental film was superimposed a transfer paper that had recorded thereon an image with an ink containing a sublimable dye "ink for ink jet printing (a set of four colors: cyan, magenta, yellow and black)" (produced by Kiwa Chemical Industry) and contact heated at 160° C. for 4 minutes. Upon peeling the separator on the back side of the ornamental film a dyed image accurately copying the original image borne by the transfer paper appeared on the lower portion of the pressure sensitive adhesive layer as backed by the white coating layer. The polyester film generally has high affinity for the sublimable dye but the stretched polyester film used in this example had a high degree of crystallinity so that the sublimable dye hardly penetrates therein, with the result that the density of the dye image was not so high.

EXAMPLE 2

On a 50-μm thick biaxially stretched transparent polyester film (Teijin Tetron Film S6, trade name, produced by Teijin Limited) was first laminated a one-pack thermosetting polyester resin based clear coat paint (SENOKOYL, trade name, produced by Cashew) to a thickness of 30 μm and cured to form a transparent coating layer as a first layer. Then a white coating layer as a second layer was laminated in the same procedure as in Example 1 using the same "DUFLON 4F Fresh White". Next, a light-shielding color coating layer as a third layer was laminated in the same procedure as in Example 1 using "DUFLON 4F Fresh Black". Then, a pressure sensitive adhesive layer was laminated on the opposite surface of the film and a separator was applied thereon. The film was perforated with througholes overall the surface thereof in the same manner as in Example 1. Thermal transfer of an image was performed in the same manner as in Example 1 on the black paint coated surface of the ornamental film was superimposed a transfer paper. Upon peeling the separator on the back side of the ornamental film a dyed image accurately copying the original image borne by the transfer paper appeared on the lower portion of the pressure sensitive adhesive layer as backed by the white coating layer. The density of the dye image was apparently higher than that obtained in Example 1.

EXAMPLE 3

On a 50-μm thick biaxially stretched transparent polyester film (Teijin Tetron Film S6, trade name, produced by Teijin Limited) was first laminated a two-pack curing type acrylic urethane resin based clear coat paint (Acrylic Urethane Resin Varnish 7987, trade name, produced by Isamu Paint) to a thickness of 30 μm and cured to form a transparent coating layer as a first layer. Then a white coating layer as a second layer was laminated in the same procedure as in Example 1 using the same "DUFLON 4F Fresh White". Next, a light-shielding color coating layer as a third layer was laminated in the same procedure as in Example 1 using "DUFLON 4F Fresh Black". Then, a pressure sensitive adhesive layer was laminated on the opposite surface of the film and a heat resistant separator was applied thereon. The film was perforated with throughholes overall the surface thereof in the same manner as in Example 1. Thermal transfer of an image was performed in the same manner as in Example 1 by superimposing a transfer paper on the black paint coated surface of the ornamental film. Upon peeling the separator on the back side of the ornamental film a dyed image accurately copying the original image borne by the transfer paper appeared on the lower portion of the pressure sensitive adhesive layer as backed by the white coating layer. The density of the dye image was apparently higher than that obtained in Example 1.

Industrial Applicability

In accordance with the present invention, a unidirectionally penetrable ornamental film having improved advertising and amenity effects that maintains transparent feeling of a glass window and that of throughhole portion, is hardly peeled off from the glass window, is hardly befouled and has light resistance can be produced as a single article with ease.

What is claimed is:

1. A unidirectionally penetrable ornamental film comprising:

a laminate having a transparent resin film 3 in which a sublimable dye is diffusible, a white coating layer 2 on the transparent resin film 3, a light-shielding color coating layer 1 on the white coating layer 2, a pressure sensitive adhesive layer 4 on a surface of the transparent resin film 3 opposite to a surface on which the white coating layer 2 is provided, and a separator 5 on the pressure sensitive adhesive layer 5;

the light-shielding color of the light shielding color coating layer 1 being a color selected from the group consisting of black, intense dark achromatic color and intense dark chromatic color, wherein resins that constitute the white coating layer 2 and the light-shielding color coating layer 1 have no affinity for the sublimable dye.

2. A unidirectionally penetrable ornamental film according to claim 1, wherein the transparent resin film 3 comprises a laminate film having a transparent resin support film 3*a* and a transparent coating layer 3*b* in which the sublimable dye is diffusible, the transparent coating layer being laminated on the transparent resin support film 3*a*.

3. A unidirectionally penetrable ornamental film according to claim 2, wherein at least one of the transparent resin support film 3*a* and transparent coating layer 3*b* contains an ultraviolet absorbent.

4. A unidirectionally penetrable ornamental film according to claim 1, wherein the resin having no affinity for the sublimable dye is selected from the group consisting of a fluoro resin, a silicone resin and an olefin resin.

5. A unidirectionally penetrable ornamental film according to claim 1, wherein the transparent resin film contains an ultraviolet absorbent.

6. A unidirectionally penetrable ornamental film according to any one of claims 1 to 3, 5 or 6 wherein the ornamental film is formed with throughholes 6 having an area of 10 $mm^2$ or less in an opening ratio of 30 to 70% overall surfaces thereof.

7. A unidirectionally penetrable ornamental film according to claim 6, comprising a dye image on the light-shielding color coating surface of the ornamental film, the image being obtained by superimposing a transfer paper having recorded thereon an image with an ink containing a sublimable dye, contacting the transfer paper with the ornamental film and heating the transfer paper to pass the sublimable dye through the light-shielding color coating layer and the white coating layer to thereby transfer the dye to the transparent resin film in a high density.

8. A unidirectionally penetrable ornamental film, comprising a transparent resin film 3 in which a sublimable dye is diffusible, a white coating layer 2 on the transparent resin film 3, and a light-shielding color coating layer 1 on the white coating layer 2, wherein the transparent resin film 3 is dyed with an image comprising the sublimable dye and is formed with throughholes 6 having an area of 10 $mm^2$ or less in an opening ratio of 30 to 70% overall surfaces thereof, the ornamental film being applied to a transparent element on the side of the transparent film.

* * * * *

UNITED STATES PATENT AND TRADEMARK OFFICE

CERTIFICATE OF CORRECTION

PATENT NO. : 6,750,175 B2
DATED : June 15, 2004
INVENTOR(S) : Ken-ichi Furukawa

It is certified that error appears in the above-identified patent and that said Letters Patent is hereby corrected as shown below:

Column 6,
Line 14, replace "1,4-diaminoanthraquinone-2--" with -- 1,4-diaminoanthraquinone-2- --.
Line 16, replace "1-amino-4--anilide-anthraquinone," with -- 1-amino-4-anilide-anthraquinone, --.

Column 8,
Line 6, replace "transparent resin film contains" with -- transparent resin film 3 contains --.

Signed and Sealed this

Tenth Day of August, 2004

JON W. DUDAS
*Acting Director of the United States Patent and Trademark Office*